US008967793B2

(12) United States Patent
Maeyama

(10) Patent No.: US 8,967,793 B2
(45) Date of Patent: Mar. 3, 2015

(54) SHEET TRANSPORT DEVICE AND IMAGE FORMING DEVICE

(71) Applicant: Yuichiro Maeyama, Tokyo (JP)

(72) Inventor: Yuichiro Maeyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 52 days.

(21) Appl. No.: 13/792,684

(22) Filed: Mar. 11, 2013

(65) Prior Publication Data

US 2013/0240593 A1 Sep. 19, 2013

(30) Foreign Application Priority Data

Mar. 15, 2012 (JP) ..... 2012-059393
Mar. 15, 2012 (JP) ..... 2012-059394
Mar. 15, 2012 (JP) ..... 2012-059395

(51) Int. Cl.

| | |
|---|---|
| ***B41J 2/01*** | (2006.01) |
| ***B41J 11/00*** | (2006.01) |
| ***B41J 11/02*** | (2006.01) |
| ***B41J 11/057*** | (2006.01) |
| ***B65H 20/00*** | (2006.01) |

(52) U.S. Cl.

CPC ..... *B41J 11/005* (2013.01); *B41J 11/02* (2013.01); *B41J 11/057* (2013.01); *B65H 20/00* (2013.01); *B65H 2301/121* (2013.01); *B65H 2402/10* (2013.01); *B65H 2404/1441* (2013.01); *B65H 2406/351* (2013.01); *B65H 2801/06* (2013.01)

USPC ..... 347/104

(58) Field of Classification Search

CPC ..... B41J 11/02; B41J 11/005; B41J 11/057
See application file for complete search history.

(56) References Cited

U.S. PATENT DOCUMENTS

| | | | | |
|---|---|---|---|---|
| 5,506,606 | A * | 4/1996 | Saikawa et al. | 346/134 |
| 6,027,211 | A * | 2/2000 | Unosawa et al. | 347/104 |
| 8,132,883 | B2 | 3/2012 | Niihara et al. | |
| 8,167,307 | B2 | 5/2012 | Maeyama et al. | |
| 2011/0063644 | A1 | 3/2011 | Niihara et al. | |
| 2011/0064497 | A1 | 3/2011 | Niihara et al. | |
| 2011/0211210 | A1 | 9/2011 | Niihara et al. | |
| 2011/0229242 | A1 | 9/2011 | Morinaga et al. | |
| 2011/0298854 | A1 | 12/2011 | Sakurada et al. | |

FOREIGN PATENT DOCUMENTS

| | | | |
|---|---|---|---|
| JP | 2011-079296 | | 4/2011 |
| JP | 2011-110844 | | 6/2011 |
| JP | 2011110844 | A * | 6/2011 |
| JP | 2011-131434 | | 7/2011 |

OTHER PUBLICATIONS

Izuma Kensuke, Inkjet Recording Device, Sep. 26, 2011, JP Machine Translation.*

* cited by examiner

*Primary Examiner* — Shelby Fidler
*Assistant Examiner* — Tracey McMillion
(74) *Attorney, Agent, or Firm* — Cooper & Dunham LLP

(57) ABSTRACT

A sheet transport device includes: a sheet transporting unit that transports a sheet; a sheet guiding member that is divided into plural member portions and guides the sheet transported from the sheet transporting unit; and a common locating member that is arranged on sides of the sheet guiding member which sandwich the member portions of the sheet guiding member, and collectively locates and holds the member portions of the sheet guiding member.

10 Claims, 14 Drawing Sheets

(D1>h1>d1)

SHEET TRANSPORT DEVICE AND IMAGE FORMING DEVICE

BACKGROUND OF THE INVENTION

1. Field of the Invention

The present disclosure generally relates to a sheet transport device and an image forming device including a sheet transport device. More specifically, the present disclosure relates to a sheet transport device adapted for use in an image forming device and including a sheet guiding member which is divided into plural member portions and arranged to guide transporting of a sheet by sheet transporting units in the image forming device. The image forming device may use an inkjet printing process or an electrophotographic printing process for image formation and may include printers, copiers, facsimile devices, plotters, multi-function peripherals, etc.

2. Description of the Related Art

Among image forming devices including printers, copiers, facsimile devices, plotters, multi-function peripherals, etc., there is an ink-jet printing device which ejects ink from a printing head to a sheet (which may include various print media, such as a copy sheet, a plastic film sheet, etc.) so that an image is formed on the sheet. A sheet transport device for use in this ink-jet printing device is known. In the sheet transport device, a sheet is supported and transported by using a platen member (or a sheet guiding member) which is divided into plural member portions along a main scanning direction of the printing head (which direction is perpendicular to a sheet transporting direction). The transporting of the sheet is guided by the platen member described above.

For example, Japanese Laid-Open Patent Publication No. 2011-110844 discloses an improvement technology of an ink-jet printing device. This ink-jet printing device can easily perform adjustment of a clearance between the printing head and the platen (which will be called a head-to-platen clearance) throughout the width of the platen with high precision. This ink-jet printing device can easily perform proper adjustment of the head-to-platen clearance for several printing sheets having different thicknesses throughout the width of the platen.

Specifically, Japanese Laid-Open Patent Publication No. 2011-110844 teaches the following features of the ink-jet printing device. As shown in FIGS. 2 and 3 of Japanese Laid-Open Patent Publication No. 2011-110844, a platen member for supporting a print medium is divided along a main scanning direction of a printing head into plural platen member portions. These platen member portions of the platen member are independently movable relative to the printing head in the direction in which they move close to or apart from the printing head. Each platen member portion is located in a position at a predetermined distance from the printing head by a locating unit which moves in a direction toward a guide shaft, and the position of each platen member portion is held by a platen holding mechanism. The head-to-platen clearance between the printing head and the platen member is adjusted by locating the position of each platen member portion held by the platen holding mechanism by using the locating unit.

However, according to the teaching of Japanese Laid-Open Patent Publication No. 2011-110844, in order to secure the accuracy of the position of each platen member portion, it is necessary to carry out the machining and assembling of the chassis for mounting the platen holding mechanism with a very high level of accuracy.

SUMMARY OF THE INVENTION

In one aspect, the present disclosure provides a sheet transport device which has a simple structure and is capable of accurately locating (aligning) a platen member which is divided into plural member portions.

In another aspect, the present disclosure provides a sheet transport device which has a simple structure and is capable of accurately locating a platen member which is divided into plural member portions, and capable of accurately determining an arraying direction of the member portions of the platen member.

In an embodiment which solves or reduces one or more of the above-described problems, the present disclosure provides a sheet transport device including: a sheet transporting unit that transports a sheet; a sheet guiding member that is divided into plural member portions and guides the sheet transported from the sheet transporting unit; and a common locating member that is arranged on sides of the sheet guiding member which sandwich the member portions of the sheet guiding member, and collectively locates and holds the member portions of the sheet guiding member.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the accompanying drawings.

Figure 1:
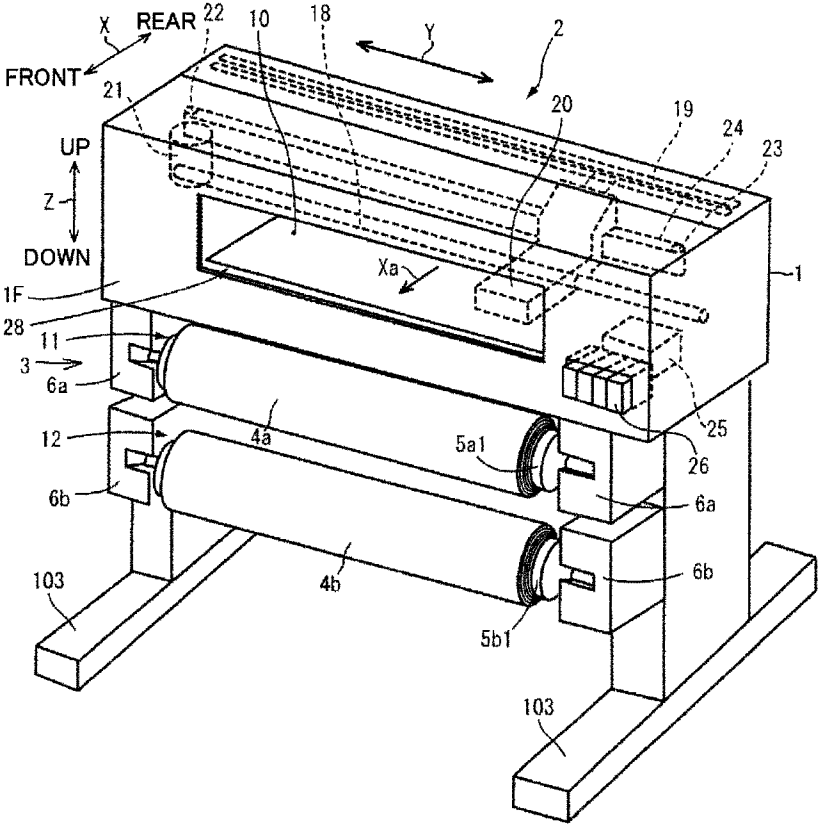
FIG. 1 is a perspective view of an image forming device according to one embodiment of the present disclosure.
Figure 2:
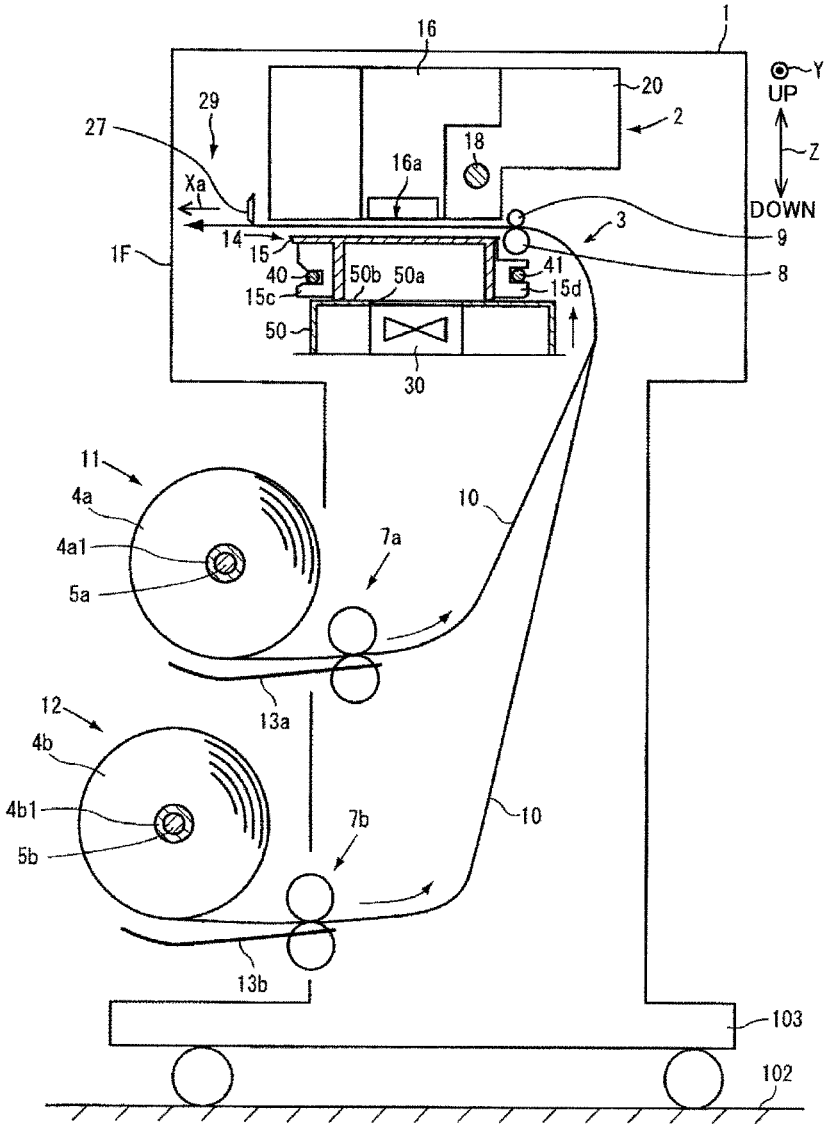
FIG. 2 is a cross-sectional side view of the image forming device of the present embodiment.

FIG. 1 is a perspective view of an image forming device according to one embodiment of the present disclosure. FIG. 2 is a cross-sectional view of the image forming device of the present embodiment.

Referring to FIG. 1 and FIG. 2, the composition of the image forming device of the present embodiment will be described.

As shown in FIG. 1 and FIG. 2, the image forming device includes an image formation part 2 and a sheet feeding part 3. The image formation part 2 is disposed in an upper part of a device main unit 1 and performs image formation on a printing sheet 10 (which is transported within the image forming device). The sheet feeding part 3 (which is an example of a sheet transport device) transports a printing sheet 10 which is delivered from one of an upper-stage roll sheet 4*a* (which is also called a rolled sheet 4*a*) and a lower-stage roll sheet 4*b* (which is also called a rolled sheet 4*b*), to the image formation part 2. The upper-stage and lower-stage roll sheets 4*a* and 4*b* are disposed under the image formation part 2.

In the image forming device of the present embodiment, an image reader part is not arranged. The image forming device of the present embodiment is, for example, a printer-type image forming device which performs image formation based on image data read from a storage medium, such as a compact disk (CD), or input image data received from an external computer.

In FIGS. 1 and 2, X denotes a front/rear direction of the image forming device (which direction is a sub-scanning direction), Y denotes a sheet width direction or a left/right direction of the image forming device (which direction is a main scanning direction), and Z denotes an up/down direction of the image forming device (which is a vertical direction). The front/rear direction X is perpendicular to the up/down direction Z, and is equivalent to the sub-scanning direction of the image formation part 2. The left-hand side of the device main unit 1 shown in FIG. 2 is equivalent to a front face 1F of the device main unit 1, and the right-hand side of the device main unit 1 shown in FIG. 2 is equivalent to a rear face of the device main unit 1. The sheet width direction Y (or the direction parallel to the width of a printing sheet) is perpendicular to both the up/down direction Z and the front/rear direction X, and is equivalent to the main scanning direction of the image formation part 2.

For example, the image formation part 2 performs image formation by using the ink-jet printing process. In this case, the image forming device of the present embodiment shown in FIG. 1 is a serial type ink-jet printing device.

The image formation part 2 is arranged in the device main unit 1, and a guide rod 18 and a guide rail 19 are arranged inside the device main unit 1, and the guide rod 18 and the guide rail 19 are engaged with a device frame side plate (not illustrated) which forms a part of a device frame which will be described later. A carriage 20 is slidably held on the guide rod 18 and the guide rail 19 so that the carriage 20 is slidable or movable in the main scanning direction Y.

Printing heads 16 which are liquid discharge heads which discharge ink drops of black (K), yellow (Y), magenta (M) and cyan (C), respectively, are mounted on the carriage 20. In the following description, these printing heads 16 will be collectively called a printing head 16. Each of these printing heads 16 mounted on the carriage 20 is equivalent to an image formation unit. Although not illustrated, a subtank for supplying the ink of a corresponding color to each printing head 16 is integrally formed with the printing head 16.

A platen member 14 (which is a sheet guiding member) is arranged in the position which faces the printing head 16, and this platen member 14 guides transport of a printing sheet 10 from a pair of a registration roller 8 and a registration pressurizing roller 9 in the sheet feeding part 3 to the printing head 16. Plural nozzles are formed in a predetermined arrangement pattern on a nozzle surface 16*a* of the printing head 16 which faces the printing sheet 10.

In the image formation part 2, the main scanning mechanism which performs the scanning movement of the carriage 20 in the main scanning direction Y includes a drive motor 21, a drive pulley 22, an idler pulley 23 and a belt member 24.

The drive motor 21 is arranged in the image formation part 2 at a left-side end portion (see FIG. 1) in the main scanning direction Y. The drive pulley 22 is connected to an output shaft of the drive motor 21 and rotated by the drive motor 21. The idler pulley 23 is arranged in the image formation part 2 at a right-side end portion (which is opposite to the positions of the drive motor 21 and the drive pulley 22) in the main scanning direction Y. The belt member 24 is wound between the drive pulley 22 and the idler pulley 23. A tension force is exerted on the idler pulley 23 by a tension spring which is not illustrated, so that the tension force may act to separate the idler pulley 23 from the drive pulley 22 in the outward direction.

One end of the belt member 24 is secured to a belt fixing part on the rear side surface of the carriage 20, and the carriage 20 is pulled in the main scanning direction Y by the belt member 24 when the belt member 24 is rotated.

An encoder sheet (not illustrated) for detecting the main scanning position of the carriage 20 in the main scanning direction Y is disposed on the carriage 20, and this encoder sheet is read by an encoder sensor (not illustrated) disposed near the carriage 20. The printing sheet 10 delivered from one of the rolled sheet 4*a* and the rolled sheet 4*b* is transported to a printing area in the main scanning area of the carriage 20 by a sheet transporting unit. This sheet transporting unit includes feed rollers 7*a* and 7*b*, the registration roller 8 and the registration pressurizing roller 9. The printing sheet 10 is intermittently transported to the printing area in the sub-scanning direction X (or in the front direction Xa of the front/rear direction X in FIG. 1 which may also be called the sheet ejection direction Xa). The sub-scanning direction X is perpendicular to the main scanning direction Y which is equivalent to the moving direction of the carriage 20.

In one of end portions of the main scanning area of the carriage 20 (which is located at the lower, right-side end of the image formation part 2 in FIG. 1), a maintenance recovery device 25 is arranged. This maintenance recovery device 25 performs maintenance and recovery of each printing head 16 in the carriage 20. In addition, a main cartridge 26 is detachably attached to the device main unit 1 at the end portion of the main scanning area of the carriage 20. In this main cartridge 26, the inks of the four colors to be supplied to the subtanks of the printing heads 16 are contained.

As shown in FIG. 2, a cutter 27 (which is a sheet cutting unit which cuts the printing sheet on which an image is printed by the image formation part 2 to a predetermined length) is arranged in the device main unit 1. For example, this cutter 27 may be a known cutter unit which is fixed to a wire and a timing belt which are wound between pulleys (one of which is connected to the drive motor 21), and, when the wire and the timing belt are moved in the main scanning direction Y by the drive motor 21 through the pulleys, the printing sheet is cut to the predetermined length.

As shown in FIG. 2, each of the rolled sheets 4*a* and 4*b* is formed in the shape of a roll by winding a long printing sheet 10 around the periphery of the corresponding one of sheet tubes 4*a*1 and 4*b*1 as a core pipe. The printing sheet 10 can be delivered from the rolled sheets 4*a* and 4*b* by inserting spool axles 5*a* and 5*b* into the sheet tubes 4*a*1 and 4*b*1 of the rolled sheets 4*a* and 4*b* and fixing the spool axles 5*a* and 5*b* to the tubes 4*a*1 and 4*b*1, respectively. In the present embodiment, the rolled sheets 4*a* and 4*b* are provided on spool supports 6*a* and 6*b* through the spool axles 5*a* and 5*b* as shown in FIG. 1, respectively, and each of the rolled sheets 4*a* and 4*b* is delivered as the printing sheet 10.

In FIG. 1, reference numerals 5*a*1 and 5*b*1 denote spool flanges which are bonded to the end portions of the spool axles 5*a* and 5*b*, respectively. The size of each of the rolled sheets 4*a* and 4*b* may be set up to be in a range of the sheet size of A0-A4 (841 mm-297 mm in width) in the sheet width direction. There may be a model in which the setting which exceeds the above-described size range is used.

The sheet feeding part 3 includes the spool supports 6*a* and 6*b*, the feed rollers 7*a* and 7*b*, the registration roller 8, and the registration pressurizing roller 9. The spool supports 6*a* and 6*b* are two stages arrayed in the up/down direction Z and the spool supports 6*a* and 6*b* are arranged to rotatably support the ends of the spool axles 5*a* and 5*b* which are inserted in and fixed to the sheet tubes 4*a*1 and 4*b*1 of the rolled sheets 4*a* and 4*b*, respectively. The feed rollers 7*a* and 7*b* form a sheet feeding unit that feeds a printing sheet 10 from one of the rolled sheets 4*a* and 4*b* and transports the printing sheet 10 to the image formation part 3. The registration roller 8 forms a registration unit which delivers the printing sheet 10 to the image formation part 2 at a predetermined timing. The registration pressurizing roller 9 selectively pressurizes and contacts the registration roller 8.

The registration roller 8 is an example of a first rotational unit that is rotatably fixed to the device frame which will be described later. The registration pressurizing roller 9 is an example of a second rotational unit that pressurizes and contacts the registration roller 8 (the first rotational unit) and follows the rotation of the registration roller 8 (the first rotational unit). The pair of the registration roller 8 and the registration pressurizing roller 9 functions as the pair of the first and second rotational units and also functions as a sheet transporting unit which transports the printing sheet 10 to the image formation part 2.

The sheet feeding part 3 includes an upper-stage roll sheet supporting part 11 to support the upper-stage rolled sheet 4*a* and a lower-stage roll sheet supporting part 12 to support the lower-stage rolled sheet 4*b*, which are arranged under the device main unit 1. A concrete structure of the upper-stage and lower-stage roll sheet supporting parts 11 and 12 may be similar to that disclosed in Japanese Laid-Open Patent Publication No. 2011-131434. For example, height dimensions of the roll sheet supporting parts 11 and 12 may be the same as those disclosed in paragraph [0045] of Japanese Laid-Open Patent Publication No. 2011-131434.

The mechanism for supporting the rolled sheet to allow transporting of the printing sheet to the device main unit is not limited to the spool mechanism of the present embodiment using the spool axle. Alternatively, a flange mechanism using a flange may be used.

In FIG. 2, reference numerals 13*a* and 13*b* denote guide plates for supporting the printing sheet 10 fed from the rolled sheet 4*a* and 4*b*, respectively, and reference numeral 29 denotes a sheet ejection part for ejecting a printing sheet on which an image is formed.

Leg supports 103 are integrally formed with the device main unit 1 under the lower-stage roll sheet supporting part 12, and castors are attached to the leg supports 103 so that the image forming device can be moved on a floor surface 102. As shown in FIG. 1, the sheet ejection part 29 includes a sheet ejection opening 28 which is formed on the downstream side of the cutter 27. The sheet ejection opening 28 functions as a sheet outlet for ejecting a printing sheet on which an image is printed to the outside of the device main unit 1. The sheet ejection opening 28 in the sheet ejection part 29 is exposed to a front face 1F of the device main unit 1 in the sheet ejection direction Xa.

Next, referring to FIG. 1 and FIG. 2, the operation of the image forming device will be described.

As shown in FIG. 1 and FIG. 2, by a mounting operation of the spool axles 5*a* and 5*b*, the rolled sheet 4*a* is placed on the upper-stage spool support 6*a* via the spool axle 5*a* and the rolled sheet 4*b* is placed on the lower-stage spool support 6*b* via the spool axle 5*b*. It is assumed that, as shown in FIG. 2, a front end of a printing sheet 10 of the rolled sheet 4*a* is set to the feed roller to and a front end of a printing sheet 10 of the rolled sheet 4*b* is set to the feed roller 7*b*.

When a key operation is performed by a user on an operation panel (which is not illustrated) arranged in the device main unit 1, for example, receiving of input data from an external computer, or setting of various image formation conditions, such as selection of one of the upper-stage and lower-stage rolled sheets 4*a* and 4*b*, selection of a color, selection of the number of sheets being printed, etc., is performed. If the user's input signal is input to a control unit (not illustrated) of the image forming device, the image forming device operates to perform the requested task.

For example, when the upper-stage roll sheet 4*a* is chosen by the key operation, rotation of a drive motor (not illustrated) which drives the spool axle 5*a* on the upper-stage spool support 6*a*, and rotation of a drive motor (not illustrated) which drives the feed roller 7*a* are initiated to rotate the spool axle 5*a* and the feed roller 7*a*, so that the printing sheet 10 is fed from the upper-stage roll sheet 4*a*.

At this time, the image formation surface of the printing sheet 10 is in a curled state and faces down. The printing sheet 10 is delivered from the device rear portion to the device front portion through a sheet transporting passage by a transporting roller (which is not illustrated). When the front end of the printing sheet 10 comes in contact with the nip part of the registration roller 8, the printing sheet 10 is temporarily stopped, and a slanting orientation of the printing sheet 10, if any, is corrected. Thereafter, the printing sheet 10 is transported at the predetermined timing to the ink-jet printing area of the image formation unit 3. Then, while the carriage 20 is moved in the main scanning direction Y and the printing sheet 10 is intermittently moved as indicated by the arrow in FIG. 2, the printing head 16 is actuated to eject ink drops according to the image data so that an image corresponding to one line is formed on the printing sheet 10.

In the printing operation, while the carriage 20 is moved, the printing head 16 of a corresponding color is actuated according to the image data, so that the ink of the corresponding color is ejected to the printing sheet 10 and an image corresponding to one line is formed on the printing sheet 10. After the printing of one line is completed, the printing sheet 10 is transported by a predetermined pitch by the registration roller 8 and the registration pressurizing roller 9, and the printing of the next line is performed.

By repeating the printing of one-line images and the transporting of the printing sheet 10 by the predetermined pitch in the above manner, the whole image as requested is formed on the printing sheet 10. When a print end signal or a signal indicating that the rear end of the printing sheet 10 has passed the printing area is received, the printing operation is terminated and the printing sheet 10 is ejected. At this time, the cutter 27 is moved in the main scanning direction Y, the printing sheet 10 after image formation is cut to the predetermined length by the cutter 27 and it is ejected to a sheet ejection tray (which is not illustrated) which is arranged on the front side of the image forming device.

If a suction fan 30 shown in FIG. 2 is driven during the printing operation, the internal pressure of the platen member 14 is turned to a negative pressure. By this negative pressure, the printing sheet 10 is attracted and held on the upper surface of the platen member 14 and image formation can be performed with the printing sheet 10 which is kept in the halted condition. The transporting force exerted by the registration roller 8 and the registration pressurizing roller 9 is larger than the air suction force exerted by the suction fan 30, and the printing sheet 19 is transported by the predetermined pitch as described above.

The image forming device of the present embodiment is an example of an ink-jet printing device, and it is important to maintain at a proper value the clearance (the head-to-platen clearance) between the nozzle surface 16*a* of the printing head 16 and the platen member 14 which guides and supports the printing sheet 10 as shown in FIG. 2. In order to output a high-quality image in which the pixel dots formed by ejection of the ink drops are arrayed with high precision, it is desirable that the clearance (the head-to-sheet clearance) between the nozzle surface 16*a* of the printing head 16 and the surface of the printing sheet 10 to be printed is as small as possible in a range so that the printing head 16 does not contact the printing sheet 1, and is kept constant in the main scanning direction Y of the printing head 16.

In the present embodiment, the platen member 14 is a sheet guiding member which guides the printing sheet 10 transported from the sheet transporting unit (which is formed by the registration roller 8 and the registration pressurizing roller 9) and is divided into plural member portions 15 (which will be called platen member portions 15).

The composition of the platen member portions 15 is simple and inexpensive. The platen member portions 15 are formed for weight reduction and can be moved (located) in any of the three-dimensional directions including the up/down, front/rear and right/left directions. In the present embodiment, the platen member portions 15 are movable in the up/down direction Z and the front/rear direction X (the sheet transporting direction).

Figure 3:
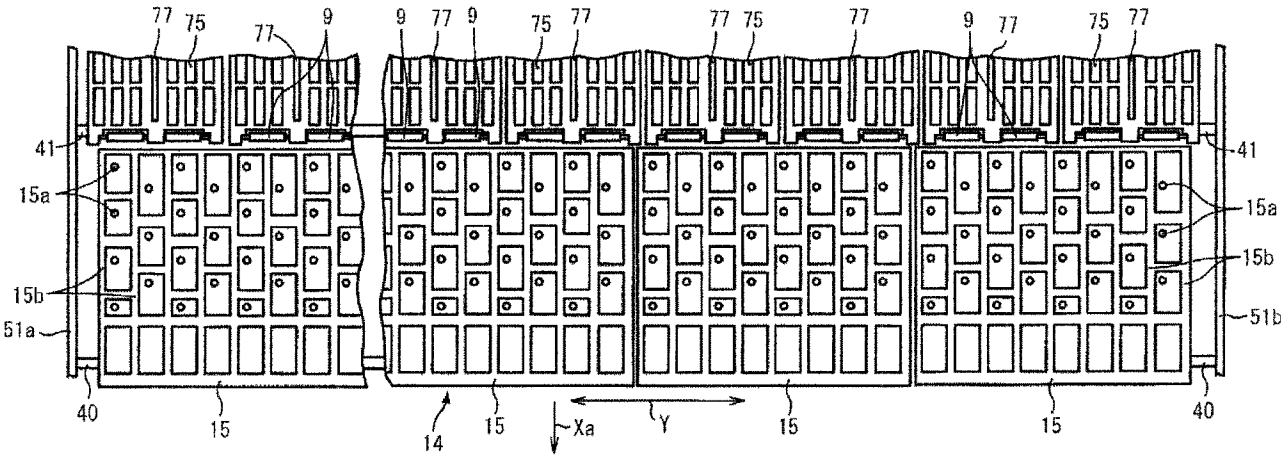
FIG. 3 is a partially cut-off plan view of platen member portions and shafts of a platen member.
Figure 4:
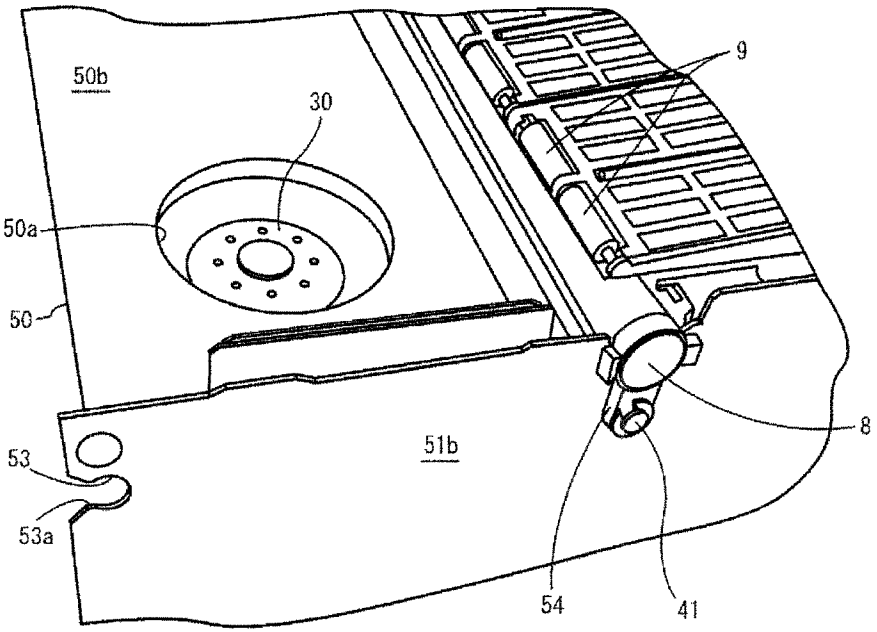
FIG. 4 is a perspective view of a part of the platen member portions in a state in which one of the shafts is removed, a holding unit for holding one of the shafts, and a suction fan in the image forming device.

Referring to FIGS. 2 to 4, the structural elements disposed in the device main unit 1 will be described. FIG. 3 is a partially cut-off plan view of the platen member portions and shafts of a platen member. FIG. 4 is a perspective view of a part of the platen member portions in a state in which one of the shafts is removed, a holding unit for holding one of the shafts, and a suction fan.

As shown in FIGS. 2 and 4, a base frame 50 which forms a part of the device frame is secured to the device main unit 1. For example, the base frame 50 is formed from a thin metal sheet (or a sheet metal) to have a box-like configuration (which has a generally rectangular cross-section). The bottom surface of the base frame 50 is formed into an opening which faces down. The base frame 50 has comparatively high rigidity and strength so that the base frame 50 may be used as a reference base to which the structural elements which will be described below are attached.

A pair of vertically extending side plates 51*a* and 51*b* which form a part of the device frame are secured to the sides of the base frame 50 in the main scanning direction Y. As shown in FIG. 2 and FIG. 4, the suction fan 30 is disposed inside the side plate 51*b* of the base frame 50. An opening 50*a* for air suction is formed in a top surface 50*b* of the base frame 50 at the position corresponding to the position where the suction fan 30 is disposed.

Next, the platen member portions 15 and the composition for locating (positioning) and holding the platen member portions 15 will be described.

As shown in FIGS. 2 to 4, two shafts 40 and 41 are transversely arranged on the sides of the platen member 14 which sandwich the platen member portions 15, with a predetermined interval in the front/rear direction X. Each of the shafts 40 and 41 extends transversely between the side plates 51*a* and 51*b*. The shafts 40 and 41 constitute a common locating member which collectively locates and holds the platen member portions 15. In other words, the shafts 40 and 41 are arranged on the sides of the platen member 14 which sandwich the platen member portions 15 in the sheet transporting (ejection) direction Xa to collectively locate and hold the platen member portions 15 between the shafts 40 and 41.

For example, each of the shafts 40 and 41 is formed of a solid rod member made of a metal, such as iron or stainless steel, to have a circular cross-section. Each of the shafts 40 and 41 has a predetermined rigidity and bending strength and is arranged to extend in the main scanning direction Y.

As shown in FIG. 4, the shaft 40 (not shown) on the front side of the device main unit 1 is detachably attached, so that the shaft 40 may be removed from the side plates 51*a* and 51*b*, if needed by a service person or at the time of assembly and adjustment in a factory. The shaft 41 on the rear side of the device main unit 1 is arranged near the lower part of the registration roller 8 to be in parallel with the rotational axle of the registration roller 8. Usually, removal of the shaft 41 from the side plates 51*a* and 51*b* is inhibited.

Next, the composition of a holding unit will be described with reference to FIG. 5A and FIG. 5B. FIG. 5A is a side view of a hole of the side plate 51*b* for attaching one of the shafts (shaft 40) thereto, and FIG. 5B is a cross-sectional view showing the composition of the holding unit for holding one of the shafts (shaft 40).

The composition of the side plates 51*a* and 51*b* and the composition of the holding units for holding the ends of the shafts 40 and 41 in the side plates 51*a* and 51*b* are the same, and therefore a description will be given of only the holding unit for holding the shaft 40 (not shown) in the side plate 51*b* shown in FIG. 4.

Figure 5B:
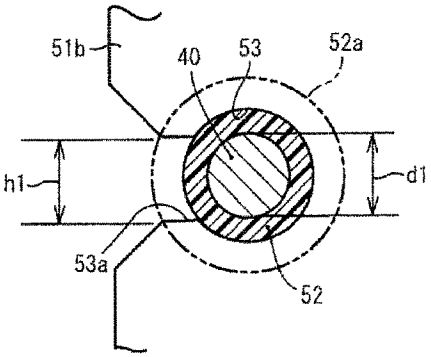
FIG. 5B is a cross-sectional view showing the composition of a holding unit for holding one of the shafts.
Figure 5A:
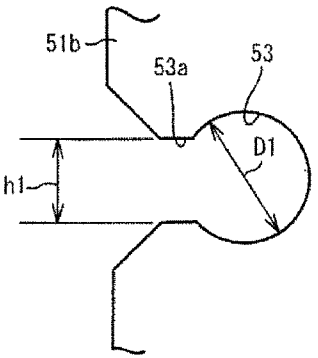
FIG. 5A is a side view of a hole of a side plate for attaching one of the shafts.

As shown in FIGS. 4, 5A and 5B, the holding unit for holding the end of the shaft 40 (or the right-hand end of the shaft 40 in the longitudinal direction of the shaft 40) in the side plate 51*b* includes a bearing 52 with a flange 52*a*, and a hole 53 with a notch slot 53*a*. As shown in FIGS. 4 and 5A, the hole 53 with the notch slot 53*a* is formed in the side plate 51*b*, so that the end portion of the shaft 40 (not shown) may be detachably held in the side plate 51*b*. The hole 53 has a diameter D1 larger than a width h1 of the notch slot 53*a* (D1>h1), and the notch slot 53*a* is cut off in the generally horizontal direction to have the width h1. As shown in FIG. 55, the bearing 52 is inserted and fitted in the hole 53, and the bearing 52 has the outwardly extending flange 52*a* integrally formed with the bearing 52. The bearing 52 is formed of, for example, a polyacetal resin (POM). It is necessary that the material of the bearing 52 has good durability and sliding characteristics relative to the shaft 40.

As shown in FIG. 5B, the bearing 52 has an outer diameter which is set to be slightly smaller than the diameter D1 of the hole 53 (with a minus tolerance to D1), and the shaft 40 is inserted and fitted in the hole 53. On the other hand, the shaft 40 has an outer diameter d1 which is set to be slightly smaller than an inner diameter of the bearing 52 (with a minus tolerance to the inner diameter of the bearing 52), and the shaft 40 is inserted and fitted inside the bearing 52. The flange 52*a*, illustrated by a two-dotted chain line in FIG. 5B, has an outer diameter larger than the outer diameter of the bearing 52, and is integrally formed on the outside of the bearing 52. The end portions of the shaft 40 project outward from the corresponding bearings 52 held in the side plates 51*a* and 51*b* and have retaining rings (not illustrated in FIG. 5B) attached to the corresponding end portions of the shaft 40. This retaining ring is a movement regulation member which regulates movement of the shaft 40 in the main scanning direction Y.

As shown in FIG. 5B, in the state in which the bearing 52 with the flange 52*a* is fitted in the hole 53 of the side plate 51*b*, the relationship of the dimensions is D1>h1>d1. Unless the retaining ring and the bearing 52 are removed from the end portion of the shaft 40, the shaft 40 cannot be removed from the hole 53 of the side plate 51*b*. In other words, if the retaining ring and the bearing 52 are removed from the end portion of the shaft 40, the shaft 40 can be removed from the holding unit of the side plate 51*b* by drawing out the end portion of the shaft 40 from the notch slot 53*a* (the relationship of the dimensions is h1>d1).

As shown in FIG. 4, the holding unit for holding the end of the shaft 41 (or the right-hand end of the shaft 41 in the longitudinal direction of the shaft 41) in the side plate 51*b* includes a connecting member 54 and a holding part formed in the side plate 51*b* for holding the connecting member 54.

The connecting member 54 is a combined bearing member in which a bearing for holding the end of the shaft 41 and a bearing for holding the registration roller 8 to allow rotation of the registration roller 8 are integrally formed. The connecting member 54 is formed of, for example, a polyacetal resin (POM). In order to hold the registration roller 8 to allow rotation of the registration roller 8, it is necessary that the material of the connecting member 54 has good durability and sliding characteristics relative to the registration roller 8. The connecting member 54 is held and fixed by the holding part formed in the side plate 51*b*. As shown in FIG. 4, the holding part includes a generally U-shaped groove formed in the side plate 51*b* and fitted in the bearing 52 of the registration roller 8, and a hole formed in the side plate 51*b* and fitted in the bearing of the shaft 41. The holding part holds the connecting member 54 with the groove and the hole of the side plate 51*b*.

End portions of the registration roller 8 and the shaft 41 project outward from the corresponding connecting members 54 held in the side plates 51*a* and 51*b* and have retaining rings (as illustrated in FIG. 4) attached to the end portions. This retaining ring is a movement regulation member which regulates movement of the registration roller 8 and the shaft 41 in the main scanning directions Y.

In the state in which the shafts 40 and 41 are held in the side plates 51*a* and 51*b* through the above-described holding units, the image forming device is set up so that the parallelism of the shafts 40 and 41, the positions of the shafts 40 and 41 in the up/down direction Z, the positions of the shafts 40 and 41 in the front/rear direction X, the straightness, etc., provide positioning references with an appropriate level of accuracy. In other words, the configuration and dimensions of the above-described parts and members of the holding units when the shafts 40 and 41 are held in the side plates 51*a* and 51*b* through the holding units are set up to provide an appropriate level of accuracy that falls within a predetermined tolerance.

Figure 6:
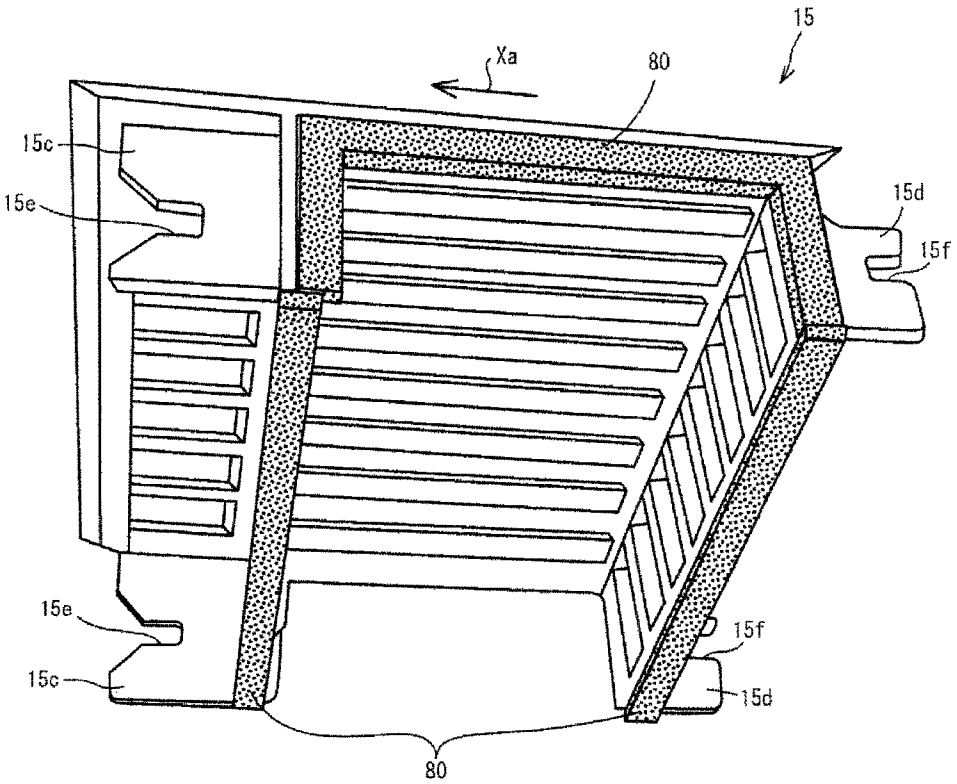
FIG. 6 is a perspective view of the platen member portions when viewed from the bottom surface thereof.
Figure 7:
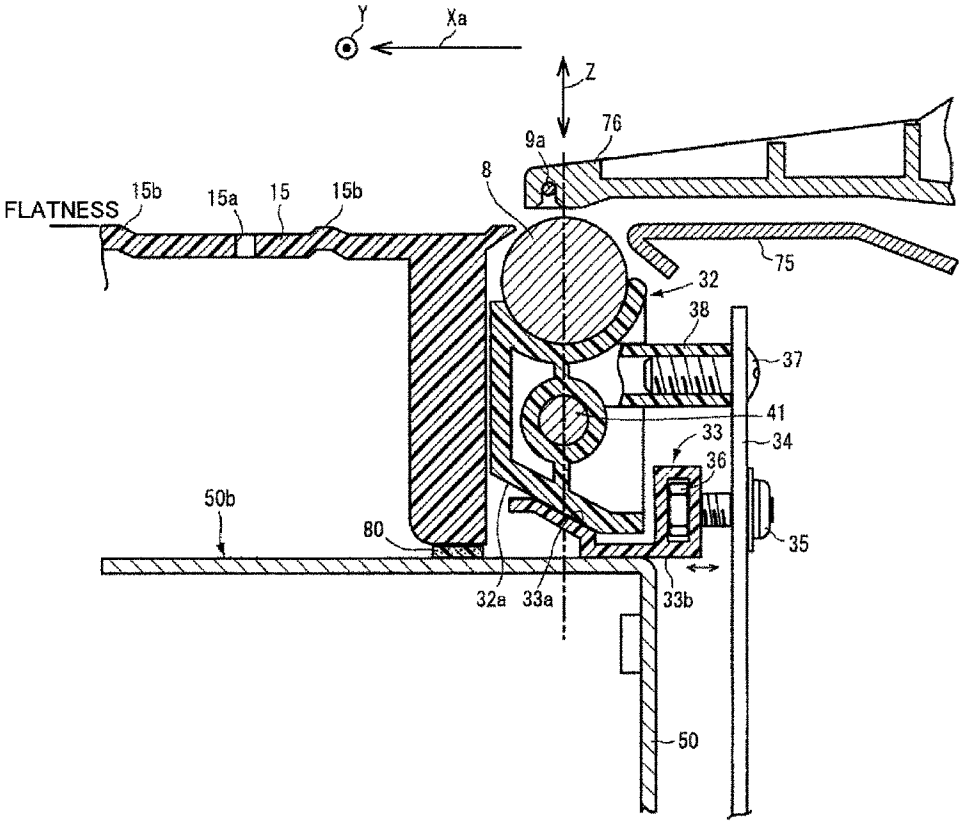
FIG. 7 is a cross-sectional side view of the platen member portions and a position correction unit.

Next, the platen member portions 15 will be described with reference to FIGS. 3, 6 and 7. FIG. 6 is a perspective view of the platen member portions 15 when viewed from the bottom surface thereof. FIG. 7 is a cross-sectional view of the platen member portions 15 and a position correction unit.

In the example shown in FIG. 3, the platen member portions 15 are nine pieces (in a case where the sheet size is A0) which are arranged in parallel in the main scanning direction Y (which is equivalent to the arraying direction of the platen member portions) and these pieces are identical in the dimensions and shape. In a case where the sheet size is A1, six pieces of the identical platen member portions 15 may be arranged in parallel in the main scanning direction Y.

For example, for the purpose of weight reduction and cost reduction, the platen member portions 15 are manufactured as common component parts, and, as shown in FIGS. 3, 6 and 7, each of the platen member portions 15 is formed in a box-like configuration and has an opening on the bottom thereof. The platen member portions 15 are integrally formed using a polycarbonate resin (PC) containing carbon black as a pigment. As shown in FIGS. 2, 3, 6 and 7, each of the platen member portions 15 includes a number of air suction holes 15*a* formed in its thickness direction, an upwardly projecting rib 15*b* formed to surround each of holes 15*a*, a pair of flanges 15*c* having fitting slots 15*e* in which the shaft 40 is fitted to hold the platen member portion 15, and a pair of flanges 15*d* having fitting slots 15*f* in which the shaft 41 is fitted to hold the platen member portion 15.

The flanges 15*c* are formed at the right-hand and left-hand end portions of each platen member portion 15 on the front side thereof with a predetermined interval in the main scanning direction Y, and each flange 15*c* has a fitting slot 15*e* which is formed in a generally U-shaped configuration in which the opening faces to the front direction Xa. The flanges 15*d* are formed at the right-hand and left-hand end portions of each platen member portion 15 on the rear side thereof with a predetermined interval in the main scanning direction Y, and each flange 15*d* has the fitting slot 15*f* which is formed in a generally U-shaped configuration in which the opening faces to the rear direction opposite to the front direction Xa. Each fitting slot 15*e* has a width which is set up with a plus tolerance relative to the outer diameter of the shaft 40, and the shaft 40 has the outer diameter that is set up with a minus tolerance relative to the width of the fitting slot 15*e*. Each fitting slot 15*f* has a width which is set up with a plus tolerance relative to the outer diameter of the shaft 41, and the shaft 41 has the outer diameter which is set up with a minus tolerance relative to the width of the fitting slot 15*f*.

The positions and dimensions of the shafts 40 and 41, and the fitting slots 15*e*, 15*b* and the top surfaces of the ribs 15*b* of the platen member portions 15 are set up, so that, when the shaft 40 is fitted in the fitting slots 15*e* of the right-hand and left-hand ends of each of the platen member portions 15 and the shaft 41 is fitted in the fitting slots 15*f* of the right-hand and left-hand ends of each of the platen member portions 15, the flatness and straightness of each top surface of the ribs 15*b* of the platen member 14 (in the state in which the platen member portions 15 are arranged) may fall within the predetermined tolerance.

As above-described, each platen member portion 15 includes the flanges 15*c* having the fitting slots 15*e* to which the shaft 40 can be attached externally from the outside of the platen member portion 15 to hold the platen member portion 15. Each platen member portion 15 includes the flanges 15*d* having the fitting slots 15*f* to which the shaft 41 can be attached externally from the outside of the platen member portion 15 to hold the platen member portion 15.

As shown in FIG. 6 and FIG. 7, a sponge 80 (which is an example of an elastic member) for holding airtightness is attached and fixed to the two opposed sides and the undersurface of each platen member portion 15 using a double-sided adhesive tape in an airtight manner. It is preferred that the sponge 80 is formed with individually isolated air bubbles, in order to increase the airtight holding effect. For the sake of convenience, illustration of the sponge 80 in FIGS. 2 and 3 is omitted.

Figure 8:
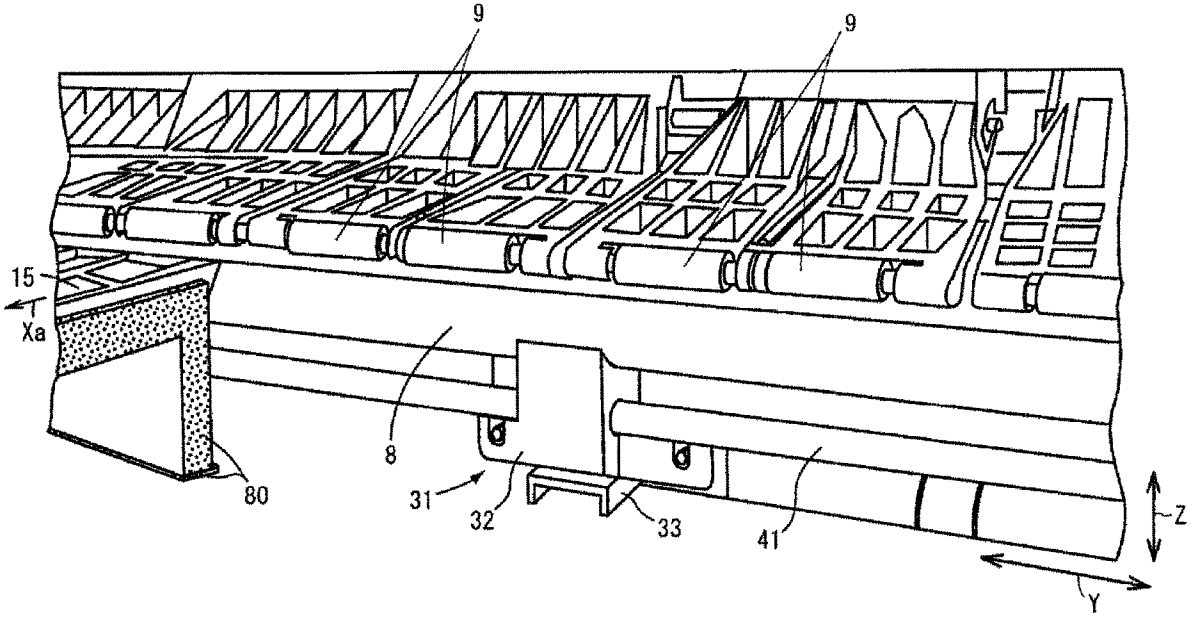
FIG. 8 is a perspective view of the position correction unit when viewed from the front side of a device main unit.

FIG. 8 is a perspective view of the position correction unit when viewed from the front side of the device main unit. As shown in FIGS. 2, 7 and 8, when the shaft 40 is fitted in the fitting slots 15*e* of the right-hand and left-hand ends of each platen member portion 15 and the shaft 41 is fitted in the fitting slots 15*f* of the right-hand and left-hand ends of each platen member portion 15, the platen member portion 15 is held by the shafts 40 and 41. In this state, each platen member portion 15 is supported on each of the shafts 40 and 41. However, the undersurfaces (bottom) of the flanges 15*c* and 15*d* of each platen member portion 15 do not directly contact the top surface 50*b* of the base frame 50, but the sponge 80 as shown in FIGS. 7 and 8 on the undersurfaces (bottom) of the flanges 15*c* and 15*d* contacts the top surface 50*b* of the base frame 50 in a compressed state.

As previously described with FIGS. 5A and 5B, if the retaining ring (which is not illustrated) and the bearing 52 are removed from the end of the shaft 40, the shaft 40 can be removed from the holding unit of the side plate 51*b* by drawing out the end of the shaft 40 from the notch slot 53*a* (the relationship of the dimensions is h1>d1). Namely, the holding unit is arranged so that the shaft 40 (which is one of the locating members (may be detachably attached to one of the side plates 51*a* and 51*b* (which form a part of the device frame). Hence, the holding state of each platen member portion 15 by the shaft 40 is canceled by the removal of the shaft 40, and exchanging each platen member portion 15 with a new platen member portion is possible.

As will be described later, the requisite for the removal of the shaft 40 from the side plates 51*a* and 51*b* is that a holding member 62 of a position adjusting unit 60 as shown in FIGS. 9 to 14 is already removed from a base member 61.

Referring to FIGS. 7 and 8, a description will be given of a position correction unit 31. The position correction unit 31 connects the shaft 41 and the registration roller 8 together and corrects a positional deviation of the shaft 41 which may take place due to the pressurization of the registration pressurizing roller 9.

FIG. 7 shows the position correction unit 31, the registration roller 8, the shaft 41 and the platen member portion 15. FIG. 8 shows the position correction unit 31, the registration roller 8, the shaft 41 and the platen member portion 15 when viewed from the front side of the device main unit.

One position correction unit 31 is disposed at each of three places in the longitudinal direction of the registration roller 8 and the shaft 41. For example, in a case where the sheet size is A0, one of the position correction units 31 is disposed at each of three places, including a central portion, an intermediate portion between the left-hand end portion and the central portion, and an intermediate portion between the right-hand end portion and the central portion of one row of the nine platen member portions 15 arrayed in the main scanning direction Y.

The position correction unit 31 includes a bearing connecting member 32, a bearing adjusting member 33, and an adjustable screw 35. The bearing connecting member 32 includes a registration roller bearing to hold the registration roller 8 to allow rotation of the registration roller 8, a shaft bearing to hold the shaft 41, a slope 32*a* and a screw fastening portion 38, which are integrally formed.

The screw fastening portion 38 is fastened and fixed to a bracket 34 (which is secured to the base frame 50) by a screw 37 after a position adjusting operation is performed by using the adjustable screw 35 (which will be described later). By the function of the screw fastening portion 38, movement of the bearing connecting member 32 is inhibited.

The bearing adjusting member 33 includes a slope 33*a* which is slidable on the slope 32*a* of the bearing connecting member 32, and a bottom wall surface 33*b* which is slidable on the top surface 50*b* of the base frame 50, which are integrally formed. The bearing adjusting member 33 further includes a nut 36 which is engaged with the adjustable screw 35 and held in a manner that inhibits rotation of the nut 36.

The bearing connecting member 32 is formed of, for example, a polyacetal resin (POM). In order to hold the registration roller 8 to allow rotation of the registration roller 8, it is necessary that the material of the bearing connecting member 32 has good durability and sliding characteristics relative to the registration roller 8. The bearing adjusting member 33 is formed of, for example, a polyacetal resin (POM). In order to smoothly slide on the slope 32*a* of the bearing connecting member 32 and on the top surface 50*b* of the base frame 50, it is necessary that the material of the bearing adjusting member 33 has good durability and sliding characteristics relative to the bearing connecting member 32 and the base frame 50.

Next, the composition in a vicinity of the registration pressurizing roller 9 will be described. In FIG. 7, reference numeral 9*a* denotes a shaft of the registration pressurizing roller 9, reference numeral 75 denotes a sheet guide plate to guide movement of a printing sheet, and reference numeral 76 denotes a pressurization arm to hold the registration pressurizing roller 9 to allow rotation of the registration pressurizing roller 9. In FIG. 3, reference numeral 77 denotes a wire spring for exerting a spring force on the registration pressurizing roller 9.

Next, the operation of the position correction unit 31 will be described. If the adjustable screw 35 is rotated in its tightening direction (which is, for example, the right-hand direction in a case where the adjustable screw is a right-hand threaded screw), the bearing adjusting member 33 slides on the top surface 50*b* of the base frame 50 and moves in the rear direction of the front/rear direction X. By this movement, the slope 33*a* of the bearing adjusting member 33 slides on the slope 32*a* of the bearing connecting member 32, and the shaft 41 and the registration roller 8 are moved upward. If the adjustable screw 35 is rotated in the reverse direction (for example, the left-hand direction), the above-described operation is reversed. In the latter case, the shaft 41 and the registration roller B are moved downward. After the position adjusting operation is performed by using the adjustable screw 35 in this manner, if the screw fastening portion 38 is fixed to the bracket 34 by fastening the screw 37, the movement of the bearing connecting member 32 in the up/down direction Z and in the main scanning direction Y is locked or inhibited.

In the present embodiment, provision of the image forming device with a low device cost and a simple structure is aimed at and the use of the shaft 41 having high rigidity and strength is not required. If the printing sheets to be used in the image forming device cover a relatively wide range of thickness, the pressuring force of the registration pressurizing roller 9 exerted on the registration roller 8 may become quite high near the central portion of the shaft 41. In such a case, a positional deviation of the platen member portions 15 may arise, and it is difficult to secure the flatness and straightness of each platen member portion 15.

However, in the present embodiment, the positional deviation of each platen member portion 15 at the places where the position correction units 31 are arranged (especially near the central portion of the shaft 41) is corrected and adjusted. Hence, the flatness and straightness of each platen member portion 15 can be secured. In this case, correction and adjustment of the shaft 41 and the registration roller 8 in the up/down direction Z is also performed, and the printing sheet transport and the registration operation can be performed stably.

Usually, the correction and adjustment operation is not performed by a user; it is performed in a manufacturing factory during the assembly and adjustment process or performed when needed by a service person. This is the same in a case where the adjustment operation is performed by using the position adjusting unit 60 as shown in FIGS. 9 to 14.

Next, the position adjusting unit 60 to adjust the position of the shaft 40 in the up/down direction Z will be described with reference to FIGS. 9 to 14.

The shaft 40 is subjected to bending and deformation due to the influences of the weight of the shaft 40 and the weight of each platen member portion 15 over an extended period of time. The position adjusting unit 60 is provided to adjust the position of the shaft 40 to its normal position.

Figure 9:
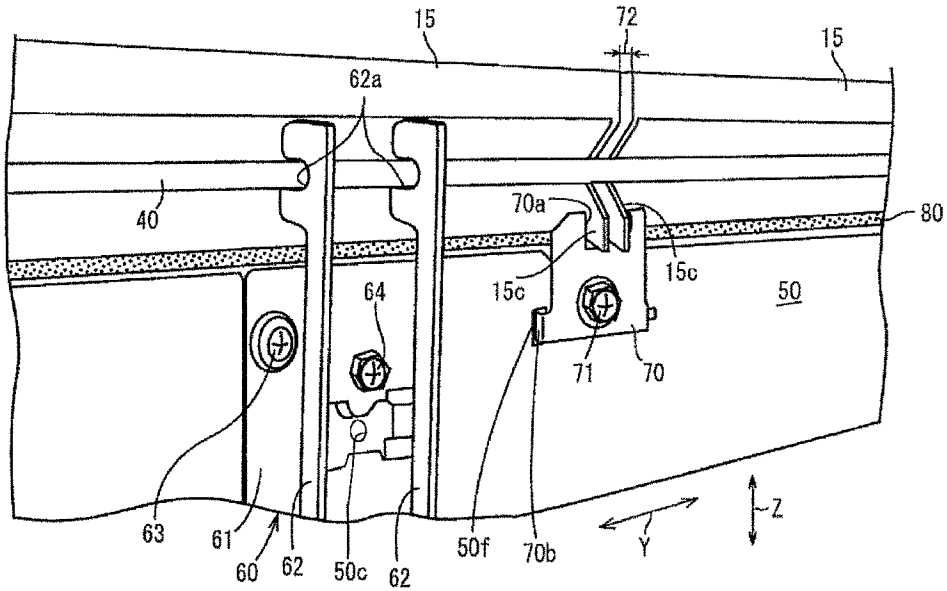
FIG. 9 is a perspective view of a position adjusting unit after assembly.
Figure 10A:
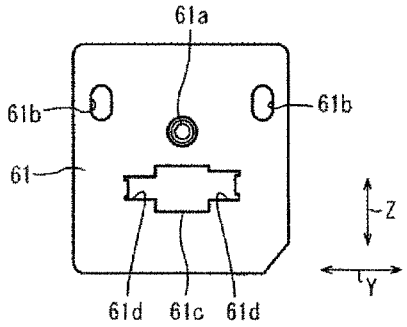
FIG. 10A and FIG. 10B are diagrams showing a base member, and a base frame to which the base member and a holding member are attached.
Figure 10B:
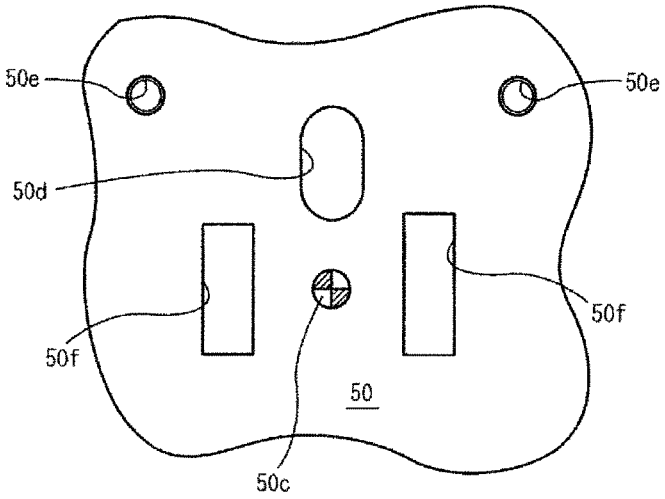
Figure 11:
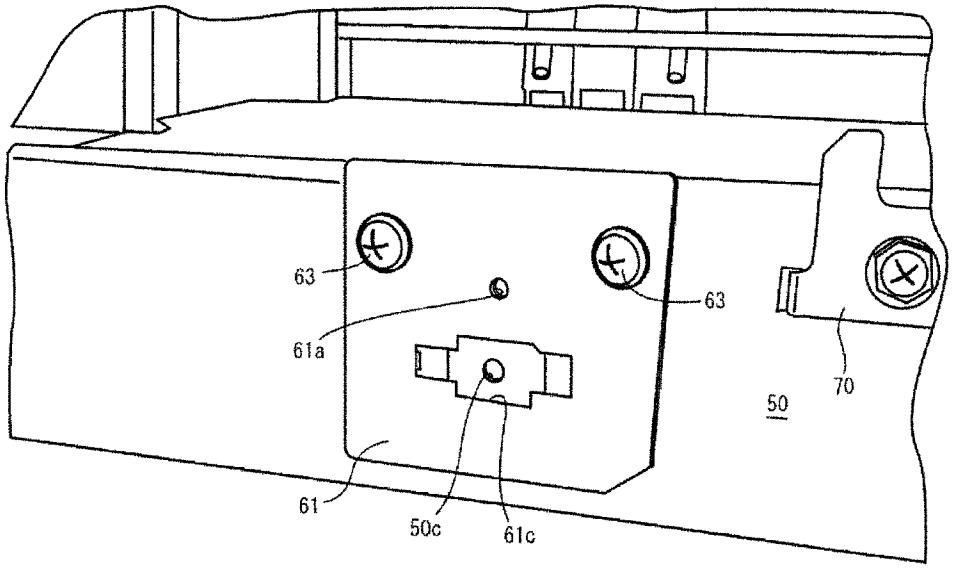
FIG. 11 is a perspective view of the position adjusting unit shown in FIG. 9 in a state where the holding member is removed.
Figure 12:
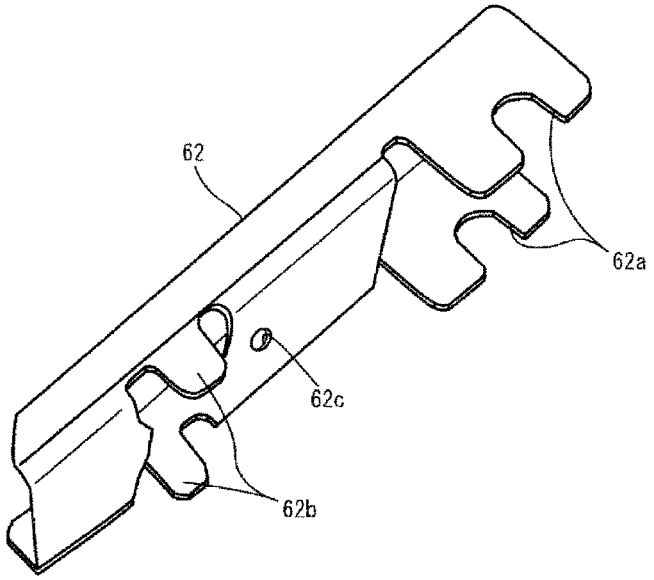
FIG. 12 is a perspective view of the holding member.
Figure 13:
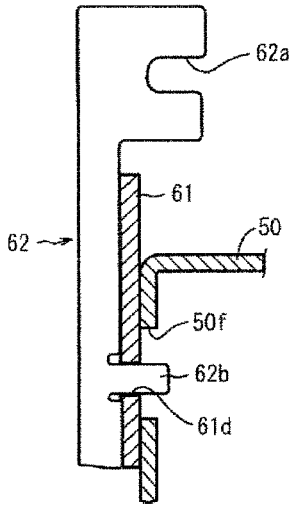
FIG. 13 is a cross-sectional view of the position adjusting unit after assembly.
Figure 14:
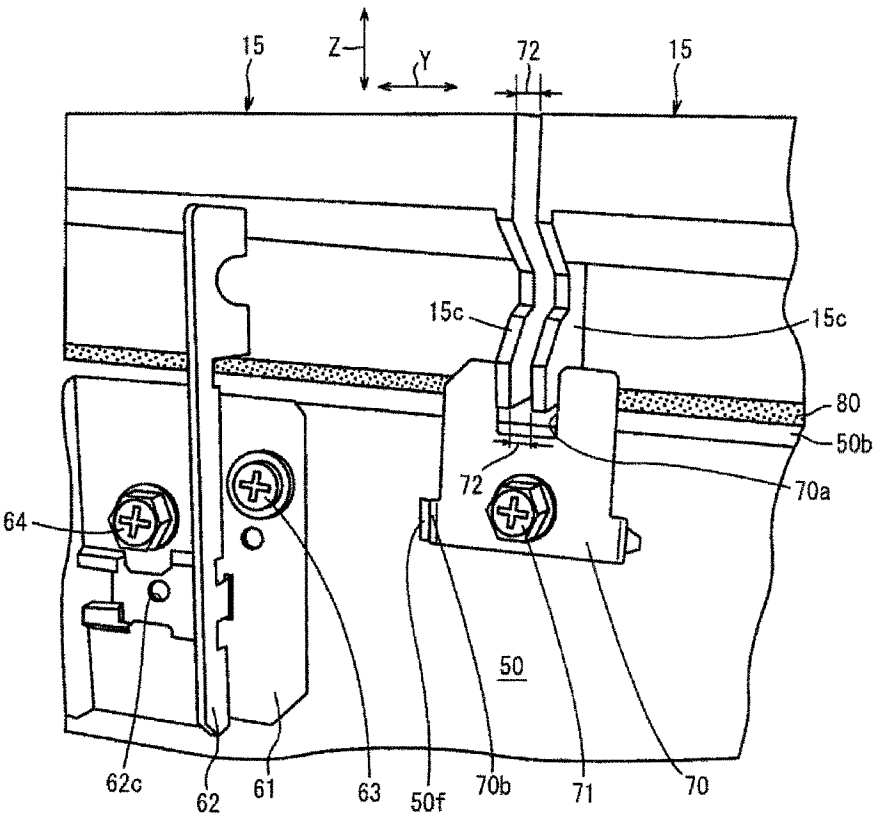
FIG. 14 is a perspective view of the position adjusting unit and a regulation member after assembly in a state in which a shaft is removed.

FIG. 9 is a perspective view of the position adjusting unit 60 after assembly. FIG. 10A and FIG. 10B are diagrams showing the base member 61, and the base frame 50 to which the base member 61 and the holding member 62 are attached. FIG. 11 is a perspective view of the position adjusting unit 60 shown in FIG. 9 in a state where the holding member 62 is removed. FIG. 12 is a perspective view of the holding member 62. FIG. 13 is a cross-sectional view of the position adjusting unit 60 after assembly. FIG. 14 is a perspective view of the position adjusting unit 60 and a regulation member 70 after assembly in a state in which the shaft 40 is removed.

The position adjusting units 60 are disposed at three places in the longitudinal direction of the shaft 40 (in a case where the sheet size is A0, which include a central portion, an intermediate portion between the left-hand end portion and the central portion, and an intermediate portion between the right-hand end portion and the central portion of one row of the nine platen member portions 15 arrayed in the main scanning direction Y), which correspond to the positions of the position correction units 31 in the main scanning direction Y.

The position adjusting unit 60 includes the base member 61 and the holding member 62. The base member 61 is positioned and fixed to the base frame 50 beforehand. The holding member 62 is detachably attached to the base member 61 to hold the shaft 40. The base member 61 and the holding member 62 are formed by a press forming process of the sheet metal, for example.

As shown in FIGS. 9, 12 and 13, the holding member 62 includes bearing portions 62*a* for holding the shaft 40, leg flanges 62*b*, and a fixing hole 62*c* in which a connecting screw 64 (FIG. 9) is inserted to fix the holding member 62 to the base member 61. The bearing portions 62*a*, the leg flanges 62*b* and the fixing hole 62*c* are integrally formed.

As shown in FIGS. 10A and 11, the base member 61 includes a screw hole 61*a*, holes 61*b*, and an opening 61*c* which are formed therein. The screw hole 61*a* is threaded and engaged with the connecting screw 64 (FIG. 9) to fix the holding member 62. The holes 61*b* are formed on the right and left sides of the screw hole 61*a*. Fixing screws 63 shown in FIGS. 9 and 11 (which are examples of the fastening members) are inserted in the holes 61*b*. The opening 61*c* includes cut-off portions 61*d* in which the leg flanges 62*b* of the holding member 62 (FIG. 12) are inserted.

As shown in FIG. 10B, the base frame 50 includes a reference hole 50*c*, a slot 50*d*, screw holes 50*e* and rectangular openings 50*f*. The slot 50*d* has a size larger than that of the connecting screw 64 (FIG. 9) and is loosely fitted with the connecting screw 64. The screw holes 50*e* are formed on the right and left sides of the slot 50*d*. The screw holes 50*e* are threaded and engaged with the fixing screws 63 (FIGS. 9 and 11). The rectangular openings 50*f* are formed on the right and left sides of the reference hole 50*c*. The rectangular openings 50*f* have a length greater than that of the cut-off portions 61*d* of the base member 61 in the up/down direction Z, and are loosely fitted with the leg flanges 62*b* of the holding member 62 (FIG. 12).

As described above, removal of the holding member 62 is possible in the state where the base member 61 is fixed to the base frame 50 of the device main unit 1 by the fixing screws 63 (which are examples of the fastening members). Hence, the holding member 62 is detachably attached to the base member 61 so that the holding member 62 is detachable from the base member 61 on the side of the front side of the base frame 50 (or the front face 1F shown in FIGS. 1 and 2).

According to the present embodiment, even when the holding member 62 is removed and the platen member portion 15 is exchanged as described above, the base member 61 which is attached to the base frame 50 by the fixing screws 63 after the locating adjustment is performed remains on the base frame 50. After the platen member portion 15 is exchanged, the holding member 62 may be attached to the base member 61 again by the connecting screw 64. It is no longer necessary to adjust the position of the holding member 62 every time.

In addition, the holding member 62 may be detached from the base member 61 on the front side of the base frame 50. It is not necessary to take a large space for exchanging or adjustment operations of the platen member portion 15. Hence, it is possible to promote space saving and improve the operability.

The correction and adjustment operation using the position correction unit 31, and the assembly and adjustment operation using the position adjusting unit 60 are chiefly performed in a manufacturing factory during the assembly and adjustment process. These operations are done using jigs, measuring instruments, surface plates, etc., which are prepared for exclusive use with high precision.

Referring to FIGS. 9 and 14, the composition of the regulation member 70 will be described. As shown in FIGS. 9 and 14, in the present embodiment, the regulation member 70 is provided to regulate the position of the adjacent platen member portions 15 in the arraying direction thereof (which is in this embodiment equivalent to the main scanning direction Y (or the sheet width direction Y) perpendicular to the sheet transporting direction).

In a case where the sheet size is A0, the regulation members 70 are disposed at four places (predetermined positions) in the sheet width direction Y. In this case, each regulation member 70 is disposed at the center of the two adjacent ones of the eight platen member portions 15 and regulates the positions of the two adjacent platen member portions 15 in the arraying direction thereof. In addition, the retaining ring (not illustrated) is provided with a predetermined gap near the holding unit to hold the end portion of the shaft 40 to regulate the position of the one of the platen member portions 15. In the present embodiment, the number of the regulation members 70 used is reduced, and it is possible to promote cost reduction. Alternatively, if this effect is not needed, eight regulation members 70 may be disposed for the eight platen member portions 15, respectively.

As previously described, the sponge 80 (which is an elastic member) is fixed to the two opposed sides of each platen member portion 15, and a gap 72 in the sheet width direction Y is formed between the two adjacent platen member portions 15 via the sponge in the compressed state (not illustrated).

The regulation member 70 is formed of, for example, the sheet metal, and includes a notch 70*a* and folded flanges 70*b* which are integrally formed. The notch 70*a* (which is an example of a recess) is provided to interpose the flanges 15*c* of the two adjacent platen member portions 15 between the inner sides of the notch 70*a*. The folded flanges 70*b* are connected with the rectangular openings 50*f* the base frame 50.

The mounting of the regulation member 70 on the base frame 50 is performed as follows. That is, the regulation member 70 is disposed at the flanges 15*c* of the two adjacent platen member portions 15 arrayed in the sheet width direction Y on the shafts 40 and 41 and held via the sponge (not illustrated) so that the notch 70*a* is interposed by the flanges 15*c* between the inner sides of the notch 70*a*. Meanwhile, the flanges 70*b* of the regulation member 70 are connected with the rectangular openings 50*f* of the base frame 50, and the regulation member 70 and the base frame 50 are fastened by a screw 71 (which is a fastening member). Although not illustrated, the regulation member 70 includes a screw hole for inserting the screw 71 which is formed at a predetermined position, and this screw hole is threaded and engaged with the screw 71.

According to the present embodiment, the regulation member 70 is provided, and even if the platen member portions 15 formed of lightweight and inexpensive parts are subjected to thermal expansion due to environmental changes or others, the position of each platen member portion 15 in the sheet width direction Y can be regulated. Occurrence of problems and undesired influences due to deformations of the platen member portions 15 can be prevented.

In addition, in the present embodiment, the gap 72 in the sheet width direction Y is formed between the adjacent platen member portions 15 and it is possible to maintain the parallelism and the straightness of the platen member portions 15 over an extended period of time.

Further, in the present embodiment, the sponge 80 is disposed on the two opposed sides of the platen member portions 15, and an air suction duct can be provided by the sponge 80. The gap 72 which is formed between the adjacent platen member portions 15 can be closed by elastic deformation of the sponge 80.

As described above, according to the present embodiment, the registration roller 8 and the registration pressurizing roller 9 constitute a sheet transporting unit which transports a printing sheet 10; the platen member portions 15 constitute a sheet guiding member which is divided into plural member portions and guides the printing sheet 10 transported from the sheet transporting unit; and the shafts 40 and 41 constitute a common locating member which is arranged on sides of the sheet guiding member which sandwich the platen member portions 15, and collectively locates and holds the platen member portions 15. The sheet transport device of the present embodiment has a simple structure and the plural platen member portions 15 can be accurately located in the up/down direction Z and the front/rear direction X.

In the above-described embodiment, the position correction units 31 are disposed at three places in the longitudinal direction of the registration roller 8 and the shaft 41 (in a case where the sheet size is A0, which include the central portion, the intermediate portion between the central portion and the left-hand end-portion, and the intermediate portion between the central portion and the right-hand end portion of one row of the nine platen member portions 15 arrayed in the main scanning direction Y). However, the following modifications may be made.

Alternatively, the position correction unit 31 may be disposed in a vicinity of the inner sides of the side plates 51*a* and 51*b* where the locating member (the shafts 40 and 41) is held on the device frame (the side plates 51*a* and 51*b*). It is preferred that the position correction unit 31 is disposed in a vicinity of the inner sides of the side plates 51*a* and 51*b* where the shaft 41 is held on the side plates 51*a* and 51*b*. In this case, the position of the shaft 41 in the up/down direction can be corrected and adjusted in addition to the position of the registration roller 8.

Alternatively, the position adjusting unit 60 may be added to the position of the shaft 40 in the main scanning direction Y corresponding to the position correction unit 31 which is additionally disposed.

In the above-described embodiment, the parallelism of the shafts 40 and 41 (which are the locating members) is determined by the accumulated tolerance (error) of the component parts of the holding units disposed on the side plates 51*a* and 51*b*. Even if the tolerance (error) of each of the component parts falls within the permissible range, torsion of the shafts 40 and 41 may arise due to the accumulated tolerance (error) of the component parts. According to the above-described modifications, if torsion of the shafts 40 and 41 arises, the torsion effects can be corrected and adjusted.

The sheet transport device according to the embodiments of the present disclosure may be applied to not only the above-described image forming device but also a sheet feeding device which is arranged to include only the sheet feeding part 3.

The image formation unit in the image forming device according to the embodiments of the present disclosure is not limited to a serial type ink-jet printing device. Alternatively, any of image formation units of image forming devices, other than the serial type ink-jet printing device, such as a line type ink-jet printing device, an electrophotographic printing device, and a multi-function peripheral, may be used.

The image forming device according to the present disclosure is not limited to the image forming device shown in FIGS. 1 and 2. The image forming device according to the present disclosure may further include an image reading part which reads an image from a document. Further, in addition to the image reading part, an operation panel which is provided on the front side of the upper part of the device main unit may be included in the image forming device according to the present disclosure. For example, the operation panel may include a notification unit using a touch-sensitive LCD and an operation instructing unit using ten keys and control keys for operating the image forming device shown in FIG. 2.

The common locating member in the sheet transport device according to the embodiments of the present disclosure is not limited to the shafts 40 and 41. Alternatively, the common locating member may be a single shaft or a combination of divided shaft portions. Further, each shaft of the common locating member may not have the same diameter or configuration in the longitudinal direction thereof. In other words, each shaft may have a diameter different from that of the other shaft portions except portions contacting the fitting slots 15*e* and 15*f* of the flanges 15*c* and 15*d* of the platen member portion 15, the bearing 62*a* of the holding member 62, and the bearing of the position correction unit 31.

In the above-described embodiment, the arraying direction of the adjacent platen member portions 15 is equivalent to the main scanning direction Y (or the sheet width direction Y) which is perpendicular to the sheet transporting direction. However, the present disclosure is also applicable to a case in which the adjacent platen member portions 15 are arrayed parallel to the sheet transporting direction.

For example, as long as the rigidity and strength are so high that deflection of the shafts 40 and 41 due to the pressurization by the registration pressurizing roller 9 of the registration roller 8 may be ignored, the position correction unit 31 and the position adjusting unit 60 in the above-described embodiment may be omitted.

The materials of the component parts of the platen member portions 15, the shafts 40 and 11, the base frame 50, the side plates 51*a* and 51*b*, the position correction unit 31, the position adjusting unit 60 and the regulation member 70 are not limited to the above-described materials. If there is no need to obtain the same advantages or effects, they may be replaced by other similar materials which have the same function.

The sheet ejection direction and the arrangement which supports the rolled sheet to allow delivery of the printing sheet are not limited to the front-side arrangement of the image forming device in the above-described embodiment. Alternatively, the rear-side arrangement or the lateral-side arrangement may be selected according to the use of the device.

(1) In one embodiment, the present disclosure provides a sheet transport device including: a sheet transporting unit that transports a sheet; a sheet guiding member that is divided into plural member portions and guides the sheet transported from the sheet transporting unit; and a common locating member that is arranged on sides of the sheet guiding member which sandwich the member portions of the sheet guiding member, and collectively locates and holds the member portions of the sheet guiding member.

(2) In another embodiment, the present disclosure provides the sheet transport device according to item (1) further including a holding unit to hold end portions of the locating member in a longitudinal direction of the locating member on a device frame.

(3) In another embodiment, the present disclosure provides the sheet transport device according to item (2) wherein the sheet transporting unit includes a first rotational unit rotatably fixed to the device frame and a second rotational unit arranged to contact and pressurize the first rotational unit and follow rotation of the first rotational unit, wherein the sheet transport device further includes a position correction unit which connects the locating member and the first rotational unit and corrects a positional deviation of the locating member due to pressurization of the second rotational unit.

(4) In another embodiment, the present disclosure provides the sheet transport device according to item (3), wherein the position correction unit is disposed in a vicinity of a portion of the device frame where the locating member is held on the device frame.

(5) In another embodiment, the present disclosure provides the sheet transport device according to item (2), wherein each member portion of the sheet guiding member includes a portion to which the locating member is externally attached from an outside of the sheet guiding member.

(6) In another embodiment, the present disclosure provides the sheet transport device according to item (5), wherein the locating member includes a pair of locating units and the holding unit is arranged so that one of the locating units is detachable attached to the device frame, wherein, when the one of the locating units is removed from the device frame, a holding state of each member portion of the sheet guiding member by the one of the locating units is canceled to allow exchanging of each member portion of the sheet guiding member with a new member portion.

(7) In another embodiment, the present disclosure provides an image forming device including: the sheet transport device according to item (1); and an image formation unit which forms an image on a sheet transported from the sheet transport device, wherein the sheet transport device transports the sheet to the image formation unit.

(8) In another embodiment, the present disclosure provides a sheet transport device including: a sheet transporting unit that transports a sheet; a sheet guiding member that is divided into plural member portions and guides the sheet transported from the sheet transporting unit; a locating member that locates and holds the member portions of the sheet guiding member; and a position adjusting unit that adjusts a position of the locating member.

(9) In another embodiment, the present disclosure provides the sheet transport device according to item (8), wherein the position adjusting unit includes: a base member that is located and fixed to a device main unit; and a holding member that is detachably attached to the base member and holds the locating member, the position adjusting unit allowing adjustment of a position of the base member.

(10) In another embodiment, the present disclosure provides the sheet transport device according to item (8), wherein the holding member is arranged to allow removal of the holding member from the base member in a state where the base member is fixed to the device main unit by a fastening member.

(11) In another embodiment, the present disclosure provides the sheet transport device according to item (8), wherein the holding member is arranged so that the holding member is detachably attached to the base member on a front side of the device main unit.

(12) In another embodiment, the present disclosure provides the sheet transport device according to item (8), wherein the sheet transporting unit includes a first rotational unit rotatably fixed to the device frame and a second rotational unit arranged to contact and pressurize the first rotational unit to follow rotation of the first rotational unit, the locating member includes a pair of locating units disposed on sides of the sheet guiding member to sandwich the member portions of the sheet guiding member between the locating units, the sheet transport device further includes a position correction unit that connects the locating member and the first rotational unit and corrects a positional deviation of the locating member due to pressurization of the second rotational unit, the position correction unit is disposed on one of the locating units of the locating member, and the position adjusting unit is disposed on the other of the locating units of the locating member at a position corresponding to a position of the position correction unit.

(13) In another embodiment, the present disclosure provides an image forming device including: the sheet transport device according to item (8); and an image formation unit which forms an image on a sheet transported from the sheet transport device, wherein the sheet transport device transports the sheet to the image formation unit.

(14) In another embodiment, the present disclosure provides a sheet transport device including: a sheet transporting unit that transports a sheet; a sheet guiding member that is divided into plural member portions and guides the sheet transported from the sheet transporting unit; a locating member that locates and holds the member portions of the sheet guiding member; and a regulation member that regulates positions of two adjacent ones of the member portions of the sheet guiding member in an arraying direction of the member portions of the sheet guiding member.

(15) In another embodiment, the present disclosure provides the sheet transport device according to item (14), wherein a gap is formed between two adjacent member portions of the sheet guiding member in the arraying direction.

(16) In another embodiment, the present disclosure provides the sheet transport device according to item (14), wherein two adjacent member portions of the sheet guiding member include elastic members on two opposed sides of the adjacent member portions, respectively.

(17) In another embodiment, the present disclosure provides the sheet transport device according to item (14), wherein the regulation member includes a recess which is formed to interpose two adjacent member portions of the sheet guiding member between inner sides of the recess.

(18) In another embodiment, the present disclosure provides the sheet transport device according to item (14), wherein the arraying direction is perpendicular to a sheet transporting direction.

(19) In another embodiment, the present disclosure provides an image forming device including: the sheet transport device according to item (14); and an image formation unit which forms an image on a sheet transported from the sheet transport device, wherein the sheet transport device transports the sheet to the image formation unit.

As described in the foregoing, according to the present disclosure, the sheet guiding member divided into plural member portions has a simple structure and the member portions can be accurately located by the above-described composition.

Furthermore, according to the present disclosure, the sheet guiding member divided into plural member portions has a simple structure and the member portions can be accurately located by the above-described composition. Even if the member portions of the sheet guiding member are subjected to thermal expansion due to environmental changes, the position of each member portion in the arraying direction can be regulated. Occurrence of undesired influences due to deformations of the member portions of the sheet guiding member can be prevented.

The sheet transport device according to the present disclosure is not limited to the specifically disclosed embodiments, and variations and deformations may be made without departing from the scope of the present disclosure.

The present application is based upon and claims the benefit of priority of Japanese Patent Application No. 2012-059393, filed on Mar. 15, 2012, Japanese Patent Application No. 2012-059394, filed on Mar. 15, 2012, and Japanese Patent Application No. 2012-059395, filed on Mar. 15, 2012, the contents of which are incorporated herein by reference in their entirety.

What is claimed is:

1. A sheet transport device comprising:

a sheet transporting unit transports a sheet;

a sheet guiding member that is divided into plural member portions and guides the sheet transported from the sheet transporting unit;

a common locating member that is arranged on sides of the sheet guiding member which sandwich the member portions of the sheet guiding member, and collectively locates and holds the member portions of the sheet guiding member; and a holding unit to hold end portions of the locating member in a longitudinal direction of the locating member on a device frame, wherein the sheet transporting unit comprises a first rotational unit rotatably fixed to the device frame and a second rotational unit arranged to contact and pressurize the first rotational unit and follow rotation of the first rotational unit, and wherein the sheet transport device further comprises a position correction unit which connects the locating member and the first rotational unit and corrects a positional deviation of the locating member due to pressurization of the second rotational unit.

2. The sheet transport device according to claim 1, wherein the position correction unit is disposed in a vicinity of a portion of the device frame where the locating member is held on the device frame.

3. The sheet transport device according to claim 1, wherein each member portion of the sheet guiding member includes a portion to which the locating member is externally attached from an outside of the sheet guiding member.

4. The sheet transport device of claim 1, further comprising:

a position adjusting unit that adjusts a position of the locating member.

5. The sheet transport device of claim 1, further comprising:

a regulation member that regulates positions of two adjacent ones of the member portions of the sheet guiding member in an arraying direction of the member portions of the sheet guiding member.

6. An image forming device comprising:

the sheet transport device according to claim 1; and an image formation unit which forms an image on a sheet transported from the sheet transport device, wherein the sheet transport device transports the sheet to the image formation unit.

7. An image forming device comprising:

the sheet transport device according to claim 4; and an image formation unit which forms an image on a sheet transported from the sheet transport device, wherein the sheet transport device transports the sheet to the image formation unit.

8. An image forming device comprising:

the sheet transport device according to claim 5; and an image formation unit which forms an image on a sheet transported from the sheet transport device, wherein the sheet transport device transports the sheet to the image formation unit.

9. A sheet transport device comprising:

a sheet transporting unit that transports a sheet;

a sheet guiding member that is divided into plural member portions and guides the sheet transported from the sheet transporting unit;

a common locating member that is arranged on sides of the sheet guiding member which sandwich the member portions of the sheet guiding member, and collectively locates and holds the member portions of the sheet guiding member; and a holding unit to hold end portions of the locating member in a longitudinal direction of the locating member on a device frame, wherein each member portion of the sheet guiding member includes a portion to which the locating member is externally attached from an outside of the sheet guiding member, wherein the locating member comprises a pair of locating units and the holding unit is arranged so that one of the locating units is detachably attached to the device frame, wherein, when the one of the locating units is removed from the device frame, a holding state of each member portion of the sheet guiding member by the one of the locating units is canceled to allow exchanging of each member portion of the sheet guiding member with a new member portion.

10. An image forming device comprising:

the sheet transport device according to claim 9; and an image formation unit which forms an image on a sheet transported from the sheet transport device, wherein the sheet transport device transports the sheet to the image formation unit.

* * * * *